US005511358A

United States Patent [19]

Morita et al.

[11] Patent Number: 5,511,358

[45] Date of Patent: Apr. 30, 1996

[54] SECURING SMALL BAGS TO BELT-LIKE MEMBER

[75] Inventors: Yoshikazu Morita; Shigeharu Iwauchi; Tamotsu Ogiso, all of Tokyo, Japan

[73] Assignee: Mitsubishi Gas Chemical Company, Inc., Tokyo, Japan

[21] Appl. No.: 394,965

[22] Filed: Feb. 27, 1995

[30] Foreign Application Priority Data

Feb. 28, 1994 [JP] Japan ..... 6-030241

[51] Int. Cl.[6] ..... B65B 61/00

[52] U.S. Cl. ..... 53/128.1; 53/170; 53/449; 53/281

[58] Field of Search ..... 53/410, 449, 420, 53/453, 471, 128.1, 170, 559, 281, 282; 156/355, 517, 519, 520

[56] References Cited

U.S. PATENT DOCUMENTS

| | | | |
|---|---|---|---|
| 4,533,425 | 8/1985 | Wehle | 53/410 |
| 4,726,171 | 2/1988 | Kreager et al. | 53/410 |
| 4,907,393 | 3/1990 | Omori et al. | 53/128.1 |
| 4,995,217 | 2/1991 | Francis, Jr. | 53/410 |
| 5,009,308 | 4/1991 | Cullen et al. | 206/204 |
| 5,084,290 | 1/1992 | Morita et al. | 53/410 |
| 5,301,490 | 4/1994 | Storandt | 53/410 |

FOREIGN PATENT DOCUMENTS

| | | |
|---|---|---|
| 0568293 | 11/1993 | European Pat. Off. . |
| 1111606 | 10/1987 | Japan . |
| 356224 | 7/1989 | Japan . |

*Primary Examiner*—John Sipos
*Assistant Examiner*—Ed Tolan
*Attorney, Agent, or Firm*—Leydig, Voit & Mayer

[57] ABSTRACT

An apparatus for successively securing a plurality of small bags to a first belt-like member via an adhesive layer is provided including a transportation path for transporting the plurality of small bags, one by one, towards said first belt-like member and an attaching apparatus for simultaneously attaching a plurality of small bags on the transportation path to the first belt-like member along the feeding direction of the first belt-like member. The attaching apparatus includes a stopper which stops the small bag in the middle of the transportation path and a pusher which compresses the small bag so stopped to the adhesive layer of the first belt-like member. A plurality of the attaching apparatuses are provided along the transportation path. In one embodiment of the invention, the stopper includes an end plate to block the transportation path, a side plate to pivot the end plate towards the transportation path, and an axis to support the side plate in a rotatable manner. Another embodiment of the invention includes a pusher having a plate projecting through an aperture formed on the transportation path which pushes up the small bags toward the adhesive layer.

38 Claims, 7 Drawing Sheets

SECURING SMALL BAGS TO BELT-LIKE MEMBER

BACKGROUND OF THE INVENTION

1. Field of the Invention

The present invention relates to an apparatus for attaching a single member to be formed into a small bag shape to a belt-like member and a method therefor. More particularly, the present invention relates to an apparatus for attaching a freshness-keeping agent of a predetermined size which contains a freshness-keeping agent composition to a belt-like member, such as packaging film, and a method therefor. To be more specific, the present invention relates to an apparatus and a method for securing a freshness-keeping agent on the inside of the packaging film within which, for example, confections, coffee, soy bean flour, grain, beans, rice, rice cake, Chinese noodles, ham, sausage and delicacies are to be stored.

2. Description of the Prior Art

Conventionally, a freshness-keeping agent for foodstuffs or the like, such as an oxygen absorbing composition or desiccating composition for example, has been placed in a gas permeable packaging material formed into a small bag shape (hereinafter referred to as a "small bag"). The small bag is generally contained within a packaging member, such as a container or a bag, together with a substance to be stored, such as foodstuffs pharmaceutical or the like for which maintaining freshness is necessary.

In this case, if the small bag is simply mixed with the substance to be stored in the packing member, consumers may not be able to distinguish the small bag from the substance to be stored. In recent years, it has been realized to secure the small bag onto the packaging member so that the small bag does not commingle with the substance to be stored.

For example, the method for securing the small bag is adopted in packaging machines, such as a side pillow or cup-sealer. The method wherein adhesive, such as a hot-melt agent, is applied to the small bag, and the small bag is directly secured to a predetermined position on the inside of the packaging film forming the packaging member is realized. In the packaging machine, such as a cup-sealer, in particular, a hot-melt agent is dropped or sprayed onto the predetermined position on the inside of the packaging member made of packaging film in advance and the small bag makes contact with the packaging member during the next cycle action of the packaging machine, which thereby automatically secures the small bags to the packaging member.

In the packaging machine, such as a cup-sealer, one to several small bags, depending on the number of packaging lines at the packaging machine, can be automatically secured to the predetermined position of the packaging member during one cycle action. However,it has not yet been realized to automatically and simultaneously secure a plurality of small bags in each packaging line, for example a plurality of small bags secured in a vertical manner during one cycle action of only one packaging line of the packaging machine.

SUMMARY OF THE INVENTION

An object of the present invention is to solve problems in the prior arts as described above. An object of the present invention is to provide an apparatus and a method which enables automatic and simultaneous attachment of a plurality of small bags to the belt-like members, such as to a packaging film, in a vertical fashion at every packaging line.

A further object of the present invention is to pack a container for storage of foodstuffs by using the belt-like member to which a small bag is attached.

In order to achieve these objectives, an apparatus for successively securing a plurality of small bags to a first belt-like member via an adhesive layer according to the present invention comprises a transportation path for transporting the plurality of small bags one by one towards the first belt-like member and an attaching apparatus for simultaneously attaching a plurality of small bags on the transportation path to the first belt-like member along the transportation path of the first belt-like member. Wherein the attaching apparatus stops the small bag in the middle of said transportation path and then compresses the small bag so stopped to the first belt-like member. A plurality of the attaching apparatuses may be provided along said transportation path. In addition, a plurality of packaging lines, each for packaging of a substance to be stored with the first belt-like member may be provided, wherein said transportation path and attaching apparatus are provided for each of the lines.

An apparatus according to the present invention also comprises an adhesive application apparatus for forming a plurality of adhesive layers at a predetermined interval on the successively fed first belt-like member, wherein the attaching apparatus compresses each of the small bags to each of the adhesive layers. The attaching apparatus comprises a stopper to stop the small bags in the middle of the transportation path and a pusher to compress the small bags so stopped to the adhesive layer of the first belt-like member.

A small bag supplying apparatus is provided in the present invention to successively supply a plurality of the small bags to said transportation path. The small bag supplying apparatus feeds a second belt-like member having a plurality of the small bags to be connected with each other, the small bag supplying apparatus is comprised of the second belt-like member feeding apparatus to feed the second belt-like member, a cutter to cut the second belt-like member into individual small bags and a distributing chute to distribute said individual small bags to said transportation paths one by one. An apparatus according to the present invention further comprises a plurality of the attaching apparatuses vertically provided along the transportation path.

The stopper, mentioned previously, comprises an end plate to block the transportation path, a side plate to pivot the end plate towards said transportation path, and an axis to support the side plate in a rotatable manner.

The pusher of the present invention is comprised of a plate projecting through an aperture formed on the transportation path, and wherein said plate pushes up the small bags towards said adhesive layer. In addition, the attaching apparatus provided in the present invention further comprises a mechanism for swinging said transportation path toward the first belt-like member. Said mechanism causes said small bag waiting on the transportation path to face said first belt-like member with a small distance in between, which corresponds to the slope of the transportation path, and then said plate pushes up the small bag towards the adhesive layer.

An apparatus of the present invention is also comprised of a belt-like member feeding apparatus to successively feed said first belt-like member so that the first belt-like member faces said transportation path corresponding to a slope of the transportation path. Said transportation path comprises a sliding chute to allow small bags to slide down. The small bags mentioned previously are comprised of a freshness-keeping agent for foodstuffs, said agent contains a freshness-keeping agent composition in a gas permeable packaging material and said first belt-like member comprises packaging film used for a container for storage of foodstuffs.

The present invention also may comprise packaging lines, wherein said adhesive application apparatus, said transportation path and said attaching apparatus are provided for each of the lines and wherein one set of the distributing chute distributes the small bags divided from the second belt-like member to each of the transportation paths.

Furthermore, the present invention is comprised of a stopper moving apparatus to simultaneously move said stoppers of all the packaging lines, in addition to a pusher moving apparatus to simultaneously move said pushers of all the lines. The motion of said adhesive application apparatus, the small bag supplying apparatus and the attaching apparatus is controlled in synchronization with the motion signal for packaging a substance to be stored with said first belt-like member to which the small bags are attached.

Also, it is provided that a container supplying apparatus to successively supply containers for storing a substance to be packed, and a packaging apparatus to pack said container with said first belt-like member to which said small bags are attached comprises the present invention. The substances referred to previously may be comprised of foodstuffs and said small bag comprises a freshness-keeping agent which is made of a gas permeable packing material and a freshness-keeping agent composition, which is an oxygen absorber, being placed in said gas permeable packing material, and said first belt-like member comprises a packaging film.

An apparatus of the present invention is comprised of two of said attaching apparatuses which are vertically provided along said transportation path. In addition, each of the lines are arranged in a parallel manner.

This method comprises an apparatus for successively securing a plurality of freshness-keeping agents to a successively fed packaging film comprising an adhesive application apparatus, said apparatus forming a plurality of adhesive layers on a successively supplied packaging film with a predetermined interval; a cutter to cut a belt-like member of freshness keeping agents formed of a plurality of freshness-keeping agents connected in one direction into individual freshness-keeping agents; a chute to allow individual freshness-keeping agents to slide down one by one towards said packaging film; a stopper to stop the freshness-keeping agent in the middle of the chute; a pusher to push the freshness-keeping agent so stopped to the adhesive layer of said packaging film, wherein a plurality of said stoppers and said pushers are vertically provided along the respective chutes, and simultaneously attach a plurality of the freshness-keeping, agents to the packaging film in a vertical manner.

An apparatus according to the present invention further comprises a container supplying apparatus to supply a plurality of containers for storage of foodstuffs and a packaging apparatus to pack each container for storage of foodstuffs with a packaging film to which the freshness-keeping agent is attached, and wherein a plurality of containers for storage of foodstuffs are simultaneously packed.

The present invention is an apparatus for successively securing a plurality of small bags to a successively fed belt-like member via an adhesive layer. The apparatus comprises a transporting step for transporting a plurality of small bags one by one towards said belt-like member; attaching step for simultaneously attaching said plurality of small bags to the belt-like member along the feeding direction of the belt-like member. The attaching step stops a plurality of said small bags in the middle of the transportation path in a vertical manner and compresses the small bags so stopped to the belt-like member via said adhesive layer. Furthermore, an apparatus comprising an adhesive application step for applying adhesive to form a plurality of adhesive layers on a successively said belt-like member with a predetermined interval; wherein said attaching step compresses each of said small bags to each of said adhesive layers. The present invention also comprises a packaging step for packaging a substance to be packed with said belt-like member to which the small bags are attached.

DETAILED DESCRIPTION OF THE PREFERRED EMBODIMENTS

An embodiment of the present invention is now explained below. The embodiment illustrates the application of the present invention to the packaging of foodstuffs.

Figure 1:
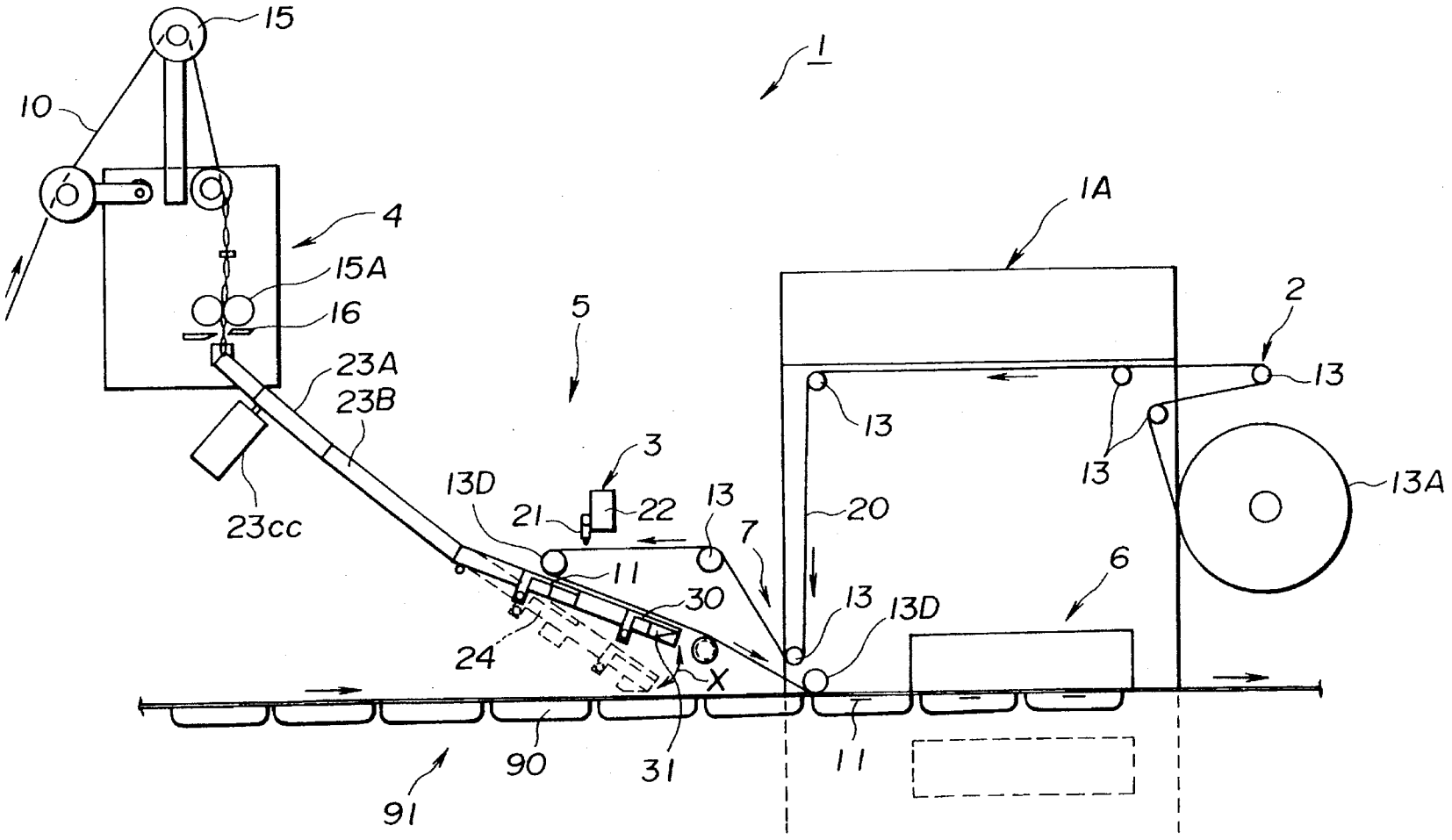
FIG. 1 is a schematic view illustrating an embodiment of an apparatus for packaging foodstuffs according to the present invention.

As shown in FIG. 1, a securing and packaging apparatus 1 to secure a plurality of small bags to a packaging film and to package foodstuffs comprises a packaging film feeding apparatus 2 to feed or supply the packaging film 20 to the apparatus 1, an adhesive application apparatus 3 to form an adhesive layer of an adhesive agent on the packaging film, a belt-like member of freshness-keeping agents supplying apparatus 4 to feed or to supply a belt-like member of freshness-keeping agents 10 and to cut the belt-like member of freshness-keeping agents into individual freshness-keeping agents, a transporting and attaching apparatus 5 to transport the freshness-keeping agents toward the packaging film and to attach the freshness-keeping agents to the packaging film, a foodstuffs container supplying apparatus 91 to supply a continuous member of a plurality of tray packs 90, each of which is filled with foodstuffs, and a packaging apparatus 6 to pack the trays with the packaging film 20 to which the freshness-keeping agents are attached. Reference numeral 1A in FIG. 1 indicates the main body of the packaging machine 6 comprising the packaging film feeding apparatus 2 and the packaging apparatus 6.

Figure 2:
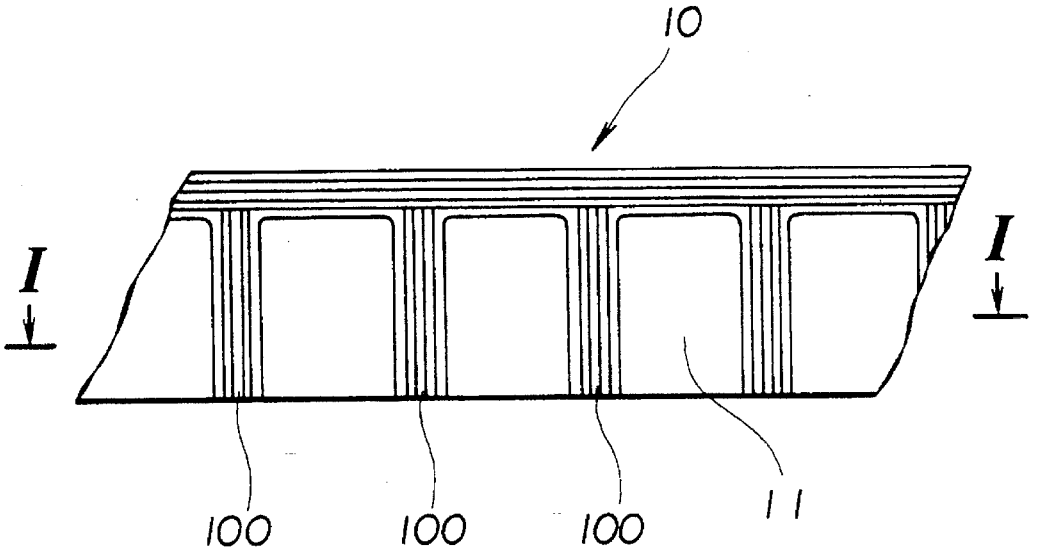
FIG. 2 is a plan view of a belt-like member of freshness-keeping agents wherein a plurality of freshness-keeping agents are being connected in one direction.
Figure 3:
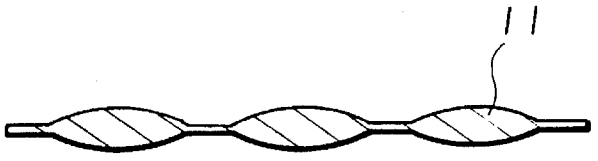
FIG. 3 is a cross section taken from I—I line of FIG. 2.

As shown in FIGS. 2 and.3, the belt-like member of the freshness-keeping agents 10 comprises a structure wherein a plurality of the freshness-keeping agent 11 are connected in one direction. One freshness-keeping agent 11 is formed by packaging a freshness-keeping agent composition with a gas permeable material, and sealing the gas permeable material at the heat-seal portion 100 positioned at a predetermined distance. The freshness-keeping agent is filled with the freshness-keeping agent composition. The gas permeable material is selected, for example, from a single film or sheet, or a laminated film or sheet. The freshness-keeping agent composition is preferred to be an oxygen absorbing composition.

The packaging film feeding apparatus 2 continuously feeds the packaging film having the gas barrier property. The inner surface of the packaging film (the surface to face the foodstuffs) is preferred to have a heat-seal property. The packaging film feeding apparatus 2 comprises a plurality of guide rollers 13 to feed the packaging film 20 toward the adhesive layer forming apparatus 3 by guiding the film. The packaging film is supplied from roll 13A to feeding apparatus 2.

The adhesive layer forming apparatus 3 forms the adhesive layer 40 (cf. FIGS. 8 to 12) by dropping or spraying an adhesive agent, preferably a hot-melt type adhesive agent, on a predetermined position of the inner surface of the packaging film 20. The apparatus 3 comprises a hot-melt gun or a hot-melt applicator 21. Numeral 22 indicates a mechanism for supplying a hot-melt adhesive agent to the hot-melt gun 21. A sufficient volume of hot-melt adhesive for attaching one freshness-keeping agent to a packaging film is applied at every pitch. The interval between each drop or spray of the hot-melt adhesive agent on a packaging film will be, for example, in relation to the size of one container of foodstuffs, if one freshness-keeping agent is attached to one container.

The hot-melt adhesive agent is made from, for example, materials that contain polypropylene or EVA (ethylene-vinyl acetate copolymer) as their main components. Of said materials, a material using polypropylene as its main component satisfies the standards for food additives pursuant to the Food Sanitation Law, and is preferable because of its high softening point and resistance to being peeled off easily.

The apparatus 4 feeds the belt-like member of the freshness-keeping agents 10 from the rollers, and also continuously feeds an individual freshness-keeping agent 11 by cutting the belt-like member at the heat-seal portion 100. As shown in FIG. 1, the supplying apparatus 4 comprises a feeding roller 15 to feed the belt-like member of the freshness-keeping agent 10, a guide roller 15A and a cutter machine 16 which comprises a pair of cutter blades to cut the heat-seal portion 100 of the belt-like member of the freshness-keeping agents 10, the blades of which approach each other or retreat from each other depending on whether they are cutting or not. The freshness-keeping agent 11 so cut out from the belt-like member is transferred to the distributing chute 23A.

Transporting and attaching apparatus 5 is located below apparatus 4. Apparatus 5 transports the freshness-keeping agent 11 to the packaging film 20, and attaches the freshness-keeping agents 11 to the packaging film 20 via the adhesive layers 40 of the packaging film. As showed in FIG. 1 and FIGS. 4 to 7, the transporting and attaching apparatus 5 comprises a transporting chute 23B as part of a transportation path to transport the freshness-keeping agent 11 and a swing chute 24 which is located below the transporting chute 23A and pivots to attach the freshness-keeping agent to the packaging film. Apparatus 5 comprises a stopper 30 in the middle of the bottom surface 30D of the chute 24 which stops the freshness-keeping agent 11 from sliding all the way down the transporting chute 23B, and a pusher (numeral 31 in FIGS. 4, 5 and 7) to push the freshness-keeping agent 11 towards the adhesive layer 40. As shown in FIG. 1, the chute 24 itself may pivot toward and away from the film 30, as shown by arrow X, around the joint of chute 24 and chute 23B.

As shown in FIG. 1, the transporting chute 23B is located below the distributing chute 23A. In this embodiment, three lines for each container packaging, which stores a foodstuff by the film 20, are provided, so a plurality (three) of the chutes 23B may be provided in a parallel manner. In this case, three sets of the apparatus 2, 3, 5 and 91 as explained before are also provided in a parallel manner.

Figure 4:
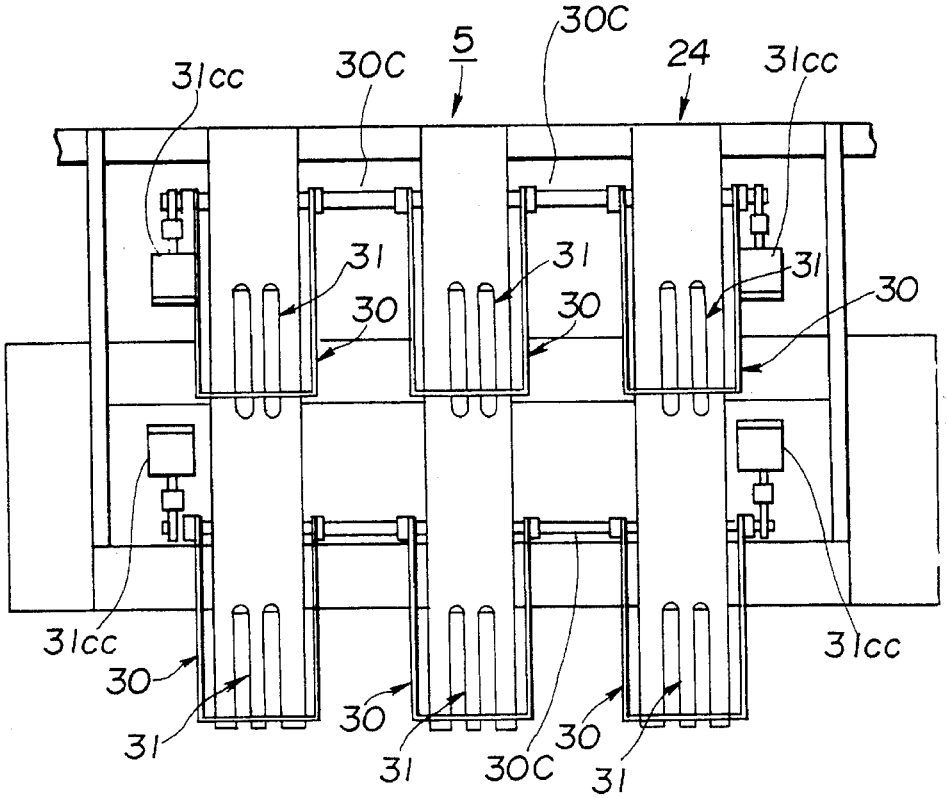
FIG. 4 is a stopper and a pusher in three lines and two pitches.

By adjusting the timing of the supply of the freshness-keeping agent in each line, one distributing chute 23A and one cutting apparatus 4 may be used for all three lines in common. In this case, the distributing chute 23A is pivoted in turn so as to engage each line. Through this structure, the freshness-keeping agents 11 may be distributed one by one to each of the three lines of chutes 24 provided in a parallel manner, as shown in FIG. 4. Numeral 23CC of FIG. 1 indicates a motor to move the chute 23A. Chute 23B and chute 24 are provided in correspondence with the feeding direction of the packaging film 20.

The shape of chutes 23A, 23B and 24 may be freely selected depending on the type of packaging apparatus 6. The acceptable shapes of the chute include a U-shape, square cylinder shape, oval cylinder shape, semi-cylindrical shape and elliptical cylinder shape. The materials to be used for a chute are either plastic, iron or a non-ferrous metal. The chute's gradient to the ground surface may be freely selected depending on such factors as size and weight of the freshness-keeping agent. An angle best suited for the smooth and quick sliding of the freshness-keeping agent in the chute should be selected. Such an angle is preferably 30 to 60 degree, and more preferably 40 to 45 degree.

As shown in FIGS. 4 to 7, the stopper 30 comprises an end plate 30A which may block or close an opening (path) in the longitudinal direction of chute 24, a pair of side plates 30B which pivot the end plate 30A toward and away from the bottom surface 30D, and the axis 30C which is located at another end of the end plate 30A and which causes the side plates 30B to pivot. One axis 30C may be used for a plurality of stoppers provided in a parallel manner, as shown in FIG. 4.

Side plates 30B are essentially L-shaped, and at the terminal end thereof, the end plate 30A is connected to the side plates 30B to form an integral unit thereof. The axis 30C is set at the beginning end of the pair of side plates 30B. When the end plate 30A of the stopper 30 pivots in a direction shown by arrow W' (V') in FIG. 5, i.e., in the direction of chute 24, the path of chute 24 may be blocked. The end plate 30A then has contact with the freshness-keeping agent 11 which slides down chute 24 and the freshness-keeping agent stops at that point of contact with end plate 30A. When side plates 30B pivot in an opposite direction (W,.V), the end plate 30A opens the path of the chute 24 to permit the freshness-keeping agent to slide down without stopping.

Figure 5:
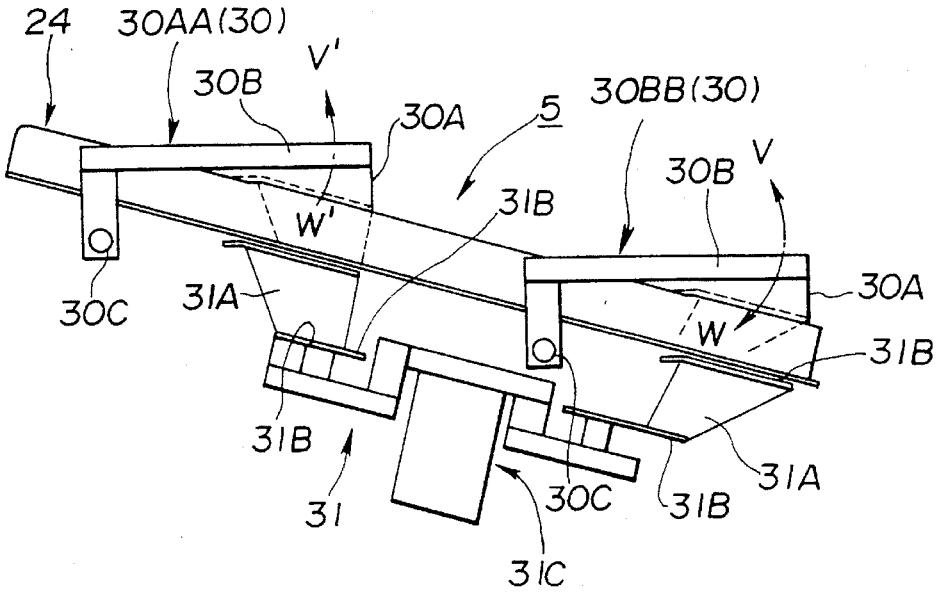
FIG. 5 is a side view of FIG. 4.
Figure 6:
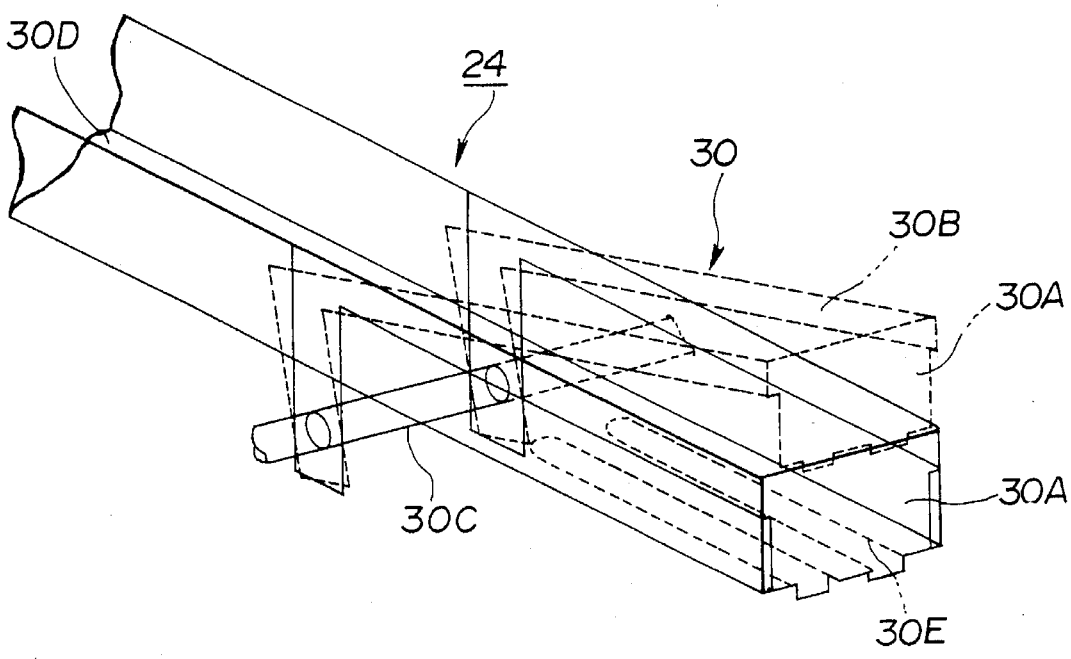
FIG. 6 is a perspective view of a stopper.

A plurality of the stoppers 30 are successively provided along the longitudinal direction, that is the feeding direction of the packaging film 20, of the chute 24 in one line. FIG. 5 illustrates the embodiment where two stoppers are vertically provided in the longitudinal direction of the chute 24. The freshness-keeping agent may be stopped at each stopper. Thereby, the motion of a plurality of the stoppers may be independently controlled. When the former stopper 30AA close to the chute 23B (left side of the drawing) is in the state of opening the path of the chute 24 (in this state, the pivot turn of the stopper 30 close to the chute 23B in V' direction has been completed) and if the latter stopper 30BB blocks the path of the chute, completing the pivot turn to W direction, the freshness-keeping agent stops on the chute by the latter stopper. When the former stopper 30AA pivots in W' direction, the freshness-keeping agent also stops at this stopper. Therefore, two freshness-keeping agents may stop on chute 24 in a vertical fashion.

Figure 7:
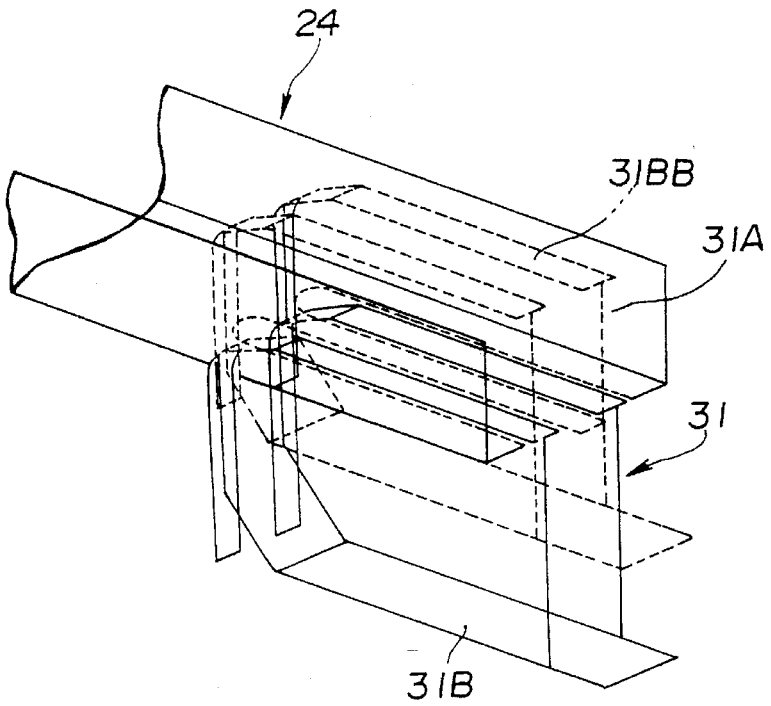
FIG. 7, is a perspective view of a pusher.

The pusher 31 as shown in FIGS. 5 and 7 pushes the freshness-keeping agent stopped on the bottom surface 30D of the chute 24 by each stopper towards the packaging film 20, and secures the freshness-keeping agent on the top face of a plate 31A, as mentioned later, to the adhesive layer 40 of the packaging film by compression. Pusher 31 is provided for each stopper. The pusher comprises a pair of plates 31A and a bottom plate 31B to which plates 31A are secured. A common pusher driving apparatus 31C for three lines of three chutes 24 is connected to the former bottom plate (left hand side in the drawing) and the latter bottom plate (right hand side in the drawing) 31B as shown in FIG. 5. The driving apparatus 31C moves each pusher back and forth with in a right angle to the longitudinal direction of the chute 24. As shown in FIG. 4, a pair of common driving apparatuses 31*cc* for driving the common axis 31C are provided on the side of three lines of the chutes 24.

As shown in FIG. 7, a pair of strip shape recesses 30E corresponding to the shape of the upper surface 31BB of the plate 31A of the pusher is formed on the chute 24. Therefore, the plate 31A may project beyond the recesses 30E toward the packaging film, or may retreat from the packaging film.

As shown in FIG. 1, the chute 24 itself swings or pivots around the beginning end of the chute 24 counter-clockwise as shown by arrow X in the drawing to the point where the chute 24 and the packaging film are positioned substantially parallel leaving a slight space in between, and then waits. The pusher 31 then projects towards the packaging film, and the freshness-keeping agent on the upper surface 31BB is compressed to the adhesive layer 40 of the packaging film. The pusher retreats from the packaging film and at the same time the chute 24 pivots clockwise as shown in the drawing to return to its original position. Thereafter, as shown in FIG. 5, the former stopper 30AA pivots in V' direction to wait for the arrival of the freshness-keeping agent in the next cycle. Having experienced the formation of the adhesive layer, the packaging film is supplied by the guide rollers 13D to face the chute 24 in a parallel manner. FIG. 1 illustrates an embodiment where the packaging film is supplied by the guide rollers 13D with gradient to the ground surface to face the chute 24, which is swung, in a parallel manner.

Packaging apparatus 6 seals or packs a container for foodstuffs by using the packaging film 20 to which the freshness-keeping agent is attached. Cups, trays or packaging bags may be used as such a container for foodstuffs. For a packaging apparatus, such types of automatic vacuum packaging machines, such as a side-pillow, cup-sealer, tray-sealer or deep drawing, may be used. In the deep drawing type automatic vacuum packaging machine, a packaging film is previously introduced over the cup, and the packaging film is heat-sealed to the upper surface of the cup at a predetermined position. The cup is then transferred by the next motion to trim the barrier films around the cup, and thus a foodstuffs packaging member with freshness-keeping agent may be successively produced. In this packaging machine 6, a plurality of trays may be simultaneously sealed with the packaging film.

Figure 13:
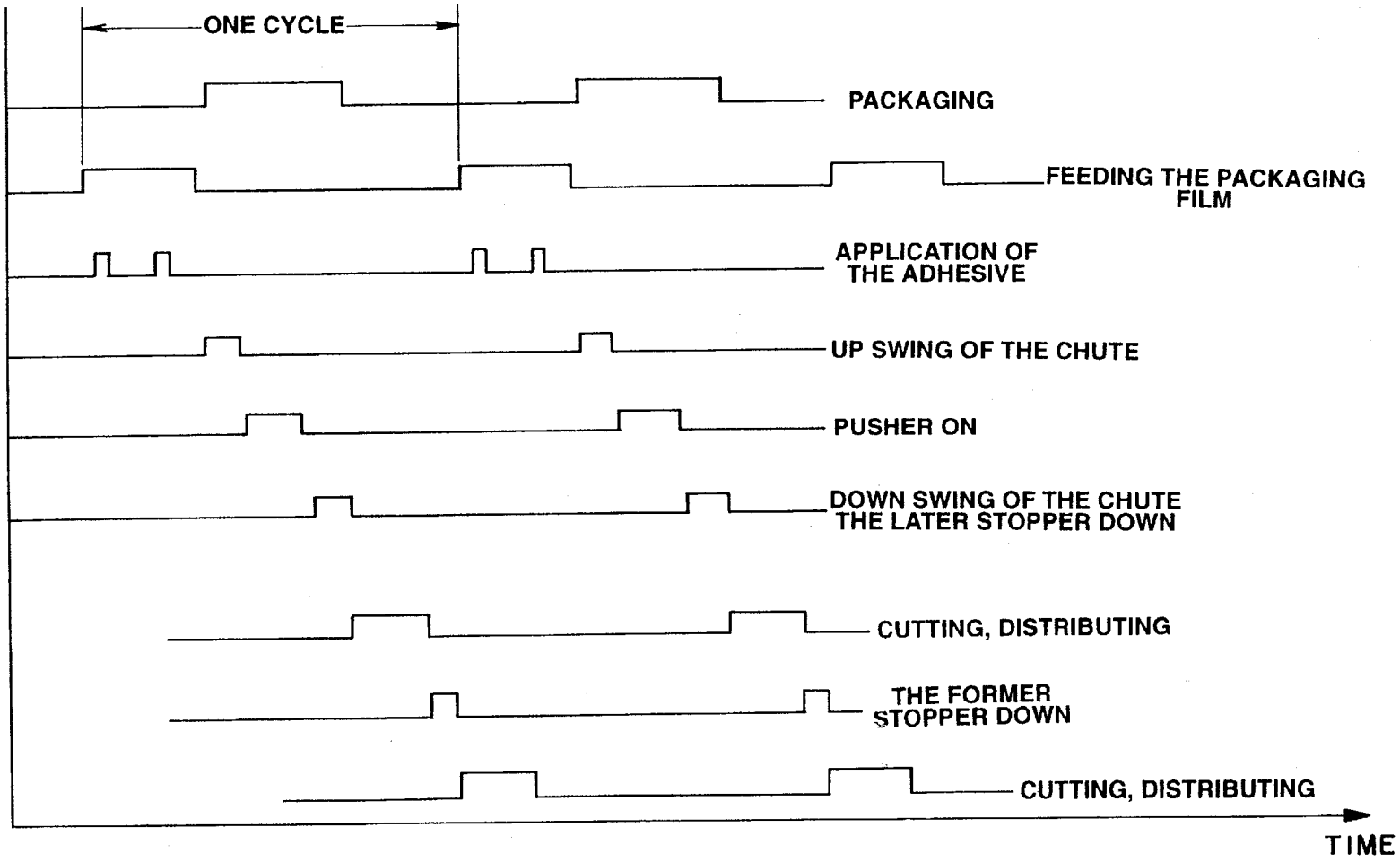
FIG. 13 is a timing chart for the present invention.

The operation of the embodiment is now explained. As explained before, three packaging lines, each for packaging of a container by the packaging film with the freshness-keeping agent, are provided. Therefor the film feeding apparatus 2, the adhesive application apparatus 3, transportation chute 23B, swing chute 24 and attaching apparatus stopper 30 and pusher 31) are provided for each of the packaging lines. The lines are provided in a parallel manner within the packaging apparatus. FIG. 13 is a timing chart showing the operation.

The timing shown in FIG. 13 synchronizes with the packaging motion at the packaging apparatus 6. A clock signal is provided to synchronize the motion of each apparatus. One cycle consists of a period of time starting from a feeding conducted at the packaging film feeding apparatus machine at a certain point and ending at the commencement of the next feeding. If a packaging is completed, the packaging film is fed two pitches for the next packaging step and then waits. One pitch is equivalent to the length of the packaging film necessary for packing one tray 90. In synchronization with the supply of the packaging film, the adhesive is dropped or sprayed twice from the hot-melt gun 21 toward the packaging film at the same time at every said three lines. At this time, two adhesive layers 40 are formed on each packaging film for two pitches with a predetermined distance.

On the other hand, after the adhesive application is finished, the chutes 24 of all lines are simultaneously swung up toward the feeding film and this condition is maintained for a predetermined time, and then the pushers of all lines are simultaneously operated to push the freshness-keeping agents on the chute 24 to the packaging film to attach the freshness-keeping agents to the packaging film at the same time. Then, the chutes 24 of all lines are simultaneously swung down to the original position. With the same timing in which chute 24 is swung down, the later stopper 30BB of every packaging line, which is close to the packaging apparatus 6, is simultaneously operated to close the path of chute 24.

Three individual freshness-keeping agents 11 are successively cut from the belt-like member of the freshness-keeping agents. While cutting the belt-like member of freshness-keeping agents, the chute 23A pivots from its original position towards each beginning end of transporting chutes 23B of the three packaging lines arranged in a parallel fashion. Chute 23A is controlled to pivot and distribute each agent to each packaging line, one by one in synchronization with the timing of each cutting of the cutter 16. The individual agent is stopped and waits at the middle position of the chute 24 by the later stopper 30BB.

When the cutting step for the first three freshness-keeping agents is finished, the former stoppers 30AA of all packaging lines are simultaneously operated to block the path of the chute 24 for a predetermined time. Then, cutting the second three agents and distributing the individual agents to each line one by one is conducted in the same manner as explained before. Therefore, the two individual bags are vertically stopped in the middle of each chute 24 in correspondence to the feeding direction of the packaging film.

Figure 8:
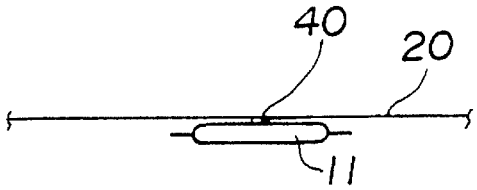
FIG. 8 is a side view illustrating a state where a freshness-keeping agent is attached to a packaging film.
Figure 9:
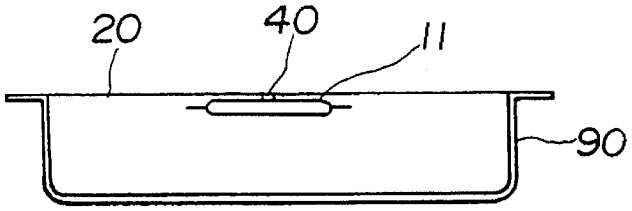
FIG. 9 is a cross section illustrating a state where a tray type container is sealed with a packaging film to which a freshness-keeping agent is attached.
Figure 10:
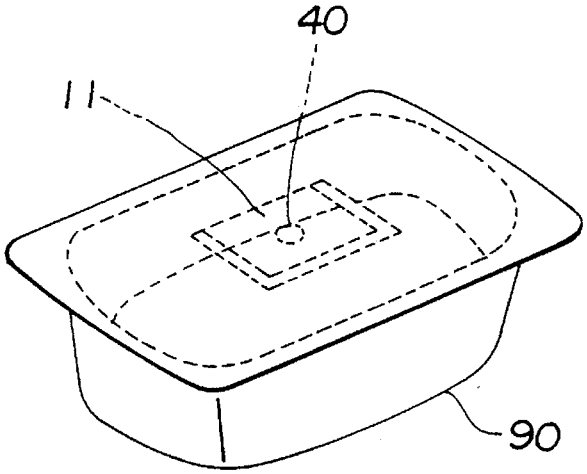
FIG. 10 is a perspective view of a tray type container shown in FIG. 9.

As shown in FIG. 1, at this time, packaging machine 6 simultaneously packs two trays at every packaging line. As a result, as shown in FIGS. 8 to 10, a package sealed at the upper open end of a foodstuffs container, a tray 90, in which a foodstuff is stored, with a packaging film on which the freshness-keeping agent 11 is secured by the adhesive layer on a-surface facing the tray is provided. A plurality of said single cycles is continuously and simultaneously repeated, resulting in the packaging of six trays being achieved in one cycle.

According to this embodiment, two freshness-keeping agents may be vertically secured to the packaging film of each packaging line. Therefore, the simultaneous packaging of six trays is performed by this embodiment. In other words, the simultaneous packaging of two trays in one cycle and in one packaging line may become possible by using the packaging film to which the freshness-keeping agents are secured at its inner surface. This results in a significant enhancement of the efficiency in the packaging of a container. The timing shown in FIG. 13 and the feeding speed of the packaging film and the packaging container and other factors are predetermined so that the freshness-keeping agent is attached at the target position of the packaging film, i.e. the portion where the adhesive layer 40 is formed.

The embodiments wherein more than three lines of each apparatus are provided in a parallel fashion is also considered to be within the scope of the present invention. Assuming four lines of the apparatuses are selected, a total of eight foodstuff packages may be obtained in one cycle through the heat-sealing of two trays for one line by four lines. In this case, the appropriate timing may be set in reference to FIG. 13. In addition, the embodiment wherein one or two lines of packaging are provided is also considered to be within the scope of the invention.

According to the present invention described above, the freshness-keeping agent may be firmly secured to the surface of the packaging film facing the foodstuffs container. Therefore, when opening a package wherein a foodstuffs container is sealed with a packaging film, the freshness-keeping agent will certainly remain within the package, and thus prevents the freshness-keeping agent and foodstuffs from being eaten together by consumers. Also, according to this invention, the plurality of small bags is secured to the film within a short period of time. According to the embodiment explained before, the packaging of six trays in one cycle is performed within five minutes.

Figure 11:
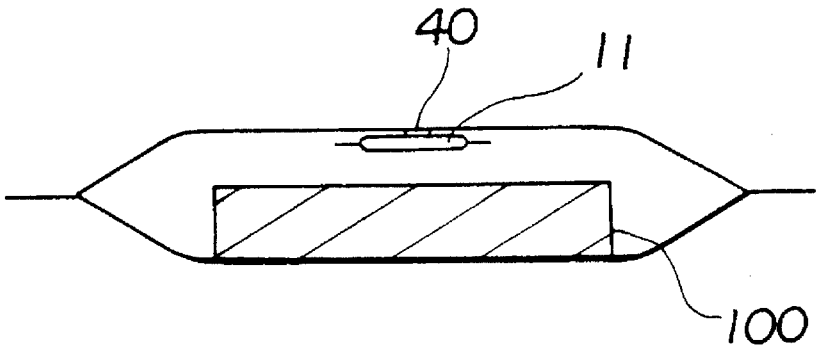
FIG. 11 is a cross section illustrating a state where a substance to be packed is packed within a package formed of a packaging film to which a freshness-keeping agent is attached.
Figure 12:
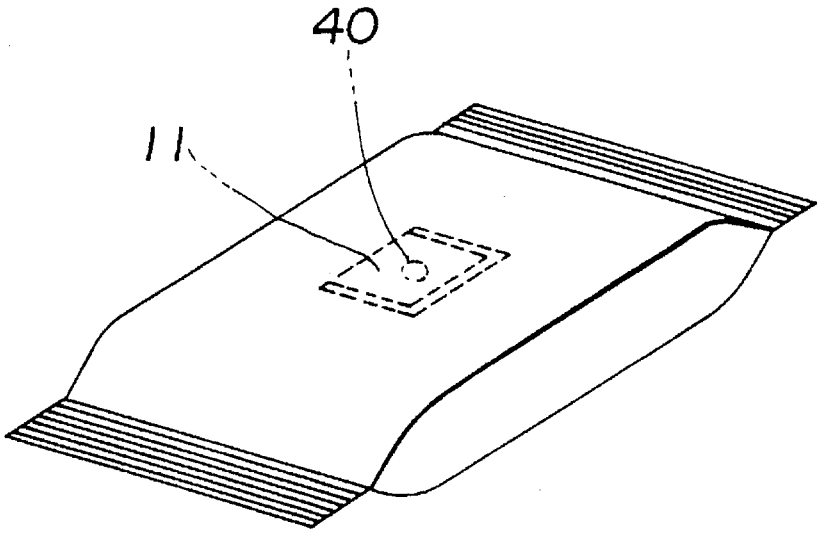
FIG. 12 is perspective view of FIG. 1.

The scope of the present invention does not intend to be limited to the embodiment described herein. Although a cup-sealer packaging machine is used as a packaging machine 6 in the explanation of the present embodiment, the present invention does not intend to be limited to such an embodiment, and deep drawing type automatic vacuum packaging machines or other type of packaging machines may be used. A foodstuff package shall not be limited to a tray, but, for example, a packaging bag to pack foodstuffs 100 with a packaging film 20, as shown in FIGS. 11 and 12 for reference purpose, may also be used. The adhesive agent shall not be limited to the hot-melt adhesive agent, but, for example, a pressure sensitive adhesive agent or other types of adhesive agents may be used. The present invention may also be applied to packaging anything other than foodstuffs. For example, the present invention may also be applied to packaging pharmaceutical. Furthermore, the present invention may be applied to various fields wherein a small bag is attached to a belt-like member, such as a film or sheet, by an adhesive layer. More than three stoppers and pushers may be vertically provided on the chute 24 of each line. The adhesive agent may be applied to the freshness-keeping agent. The freshness-keeping agent may be attached to the inside of a lid matched with a tray or a cup, instead of attaching it to the packaging film. Furthermore, in this invention, a plurality of packaging film feeding lines may be provided for a corresponding number of packaging lines. In this case, the containers are packaged by a packing film to be fed by one feeding line.

What is claimed is:

1. An apparatus for successively securing a plurality of small bags to a first belt-like member via an adhesive layer, comprising:

a transportation path for transporting the plurality of small bags one by one towards said first belt-like member; and an attaching apparatus for simultaneously attaching a plurality of small bags on said transportation path to the first belt-like member along the feeding direction of the first belt-like member, wherein said attaching apparatus comprises a stopper which stops each of said small bags in the middle of said transportation path and a pusher separate from said stopper, which pusher compresses each of said small bags so stopped to the adhesive layer of said first belt-like member and wherein a plurality of said attaching apparatuses are provided along said transportation path, wherein said stopper comprises an end plate to block said transportation path, a side plate to pivot said end plate towards said transportation path, and an axis to support the side plate in a rotatable manner, said stopper being rotatable about said axis.

2. An apparatus according to claim 1, further comprising a plurality of packaging lines, each for packaging of a substance to be preserved in a package which is at least partially formed said first-belt like member, wherein said transportation path and attaching apparatus are provided for each of said packaging lines.

3. An apparatus according to claim 1 further comprising an adhesive application apparatus for forming a plurality of adhesive layers on said successively fed first belt-like member in a predetermined interval, wherein said attaching apparatus compresses each of said small bags to each of said adhesive layers.

4. An apparatus according to claim 3, further comprising a small bag supplying apparatus to successively supply a plurality of said small bags to said transportation path.

5. An apparatus according to claim 4 wherein said small bag supplying apparatus feeds a second belt-like member having a plurality of the small bags to be connected with each other, the small bag supplying apparatus comprises said second belt-like member feeding apparatus to feed the second belt-like member, a cutter to cut the second belt-like member into individual small bags and a distributing chute to distribute said individual small bags to said transportation paths one by one.

6. An apparatus according to claim 1 wherein said plurality of said attaching apparatuses are vertically provided along said transportation path.

7. An apparatus according to claim 1 wherein said attaching apparatus further comprises a mechanism for swinging said transportation path toward the first belt-like member.

8. An apparatus according to claim 7 wherein said mechanism causes each of said small bags waiting on the transportation path to face said first belt-like member with a small distance in between corresponding to a slope of the transportation path, and then said plate pushes up each of said small bags towards the adhesive layer.

9. An apparatus according to claim 1, further comprising a belt-like member feeding apparatus to successively feed said first belt-like member so that the first belt-like member faces said transportation path corresponding to a slope of the transportation path.

10. An apparatus according to claim 1 wherein said transportation path comprises a sliding chute to allow said small bags to slide down.

11. An apparatus according to claim 1 wherein said small bag comprises a freshness-keeping agent for foodstuffs, said agent contains a freshness-keeping agent composition in a gas permeable packaging material and said first belt-like member comprises a packaging film used for a container for storage of foodstuffs.

12. An apparatus according to claim 5 wherein a plurality of packaging lines, each for a substance to be preserved in a package which is at least partially formed from said first belt-like member, are provided and wherein said adhesive application apparatus, said transportation path and said attaching apparatus are provided for each of said lines and wherein one set of said distributing chute distributes said small bags divided from said second belt-like member to each of the transportation paths.

13. An apparatus according to claim 1 wherein a plurality of lines, each for packaging of a substance to be preserved in a package which is at least partially formed from said first belt-like member are provided and wherein said stopper and pusher are each provided for each of said packaging lines and wherein said apparatus further comprises a stopper moving apparatus to simultaneously move said stoppers of all said packaging lines and further comprises a pusher moving apparatus to simultaneously move said pushers of all said packaging lines.

14. An apparatus according to claim 4 wherein motion of said adhesive application apparatus, said small bag supplying apparatus and said attaching apparatus is controlled in synchronization with a motion signal for packaging a substance to be preserved in small bags, which small bags are attached to said first belt-like member.

15. An apparatus according to claim 1, further comprising a package supplying apparatus to successively supply packages for storing a substance to be packed, and a packaging apparatus to form said package at least partially from said first belt-like member to which said small bags are attached.

16. An apparatus according to claim 14 wherein said substance comprises foodstuffs, said small bags comprise a freshness-keeping agent which is made of a gas permeable packing material and a freshness-keeping agent composition being placed in said gas permeable packing material, and said first belt-like member comprises a packaging film.

17. An apparatus according to claim 16 wherein said freshness-keeping agent is an oxygen absorber.

18. An apparatus according to claim 4 wherein two of said attaching apparatuses are vertically provided along said transportation path.

19. An apparatus according to claim 2 wherein each of said packaging lines is arranged in a parallel manner within a packaging machine.

20. An apparatus for successively securing a plurality of small bags to a first belt-like member via an adhesive layer, comprising:

a transportation path for transporting the plurality of small bags one by one towards said first belt-like member; and an attaching apparatus for simultaneously attaching a plurality of small bags on said transportation path to the first belt-like member along the feeding direction of the first belt-like member, wherein said attaching apparatus comprises a stopper which stops each of the small bags in the middle of said transportation path and a pusher which compresses each of the small bags so stopped to the adhesive layer of said first belt-like member and a plurality of said attaching apparatuses are provided along said transportation path, said pusher comprising a plate projecting through an aperture formed on the transportation path which pushes up the small bags towards said adhesive layer.

21. An apparatus according to claim 20, further comprising a plurality of packaging lines, each for packaging of a substance to be preserved in a package which is at least partly formed from said first belt-like member, wherein said transportation path and attaching apparatus are provided for each of said packaging lines.

22. An apparatus according to claim 20 further comprising an adhesive application apparatus for forming a plurality of adhesive layers on said successively fed first belt-like member in a predetermined interval, wherein said attaching apparatus compresses each of said small bags to each of said adhesive layers.

23. An apparatus according to claim 22, further comprising a small bag supplying apparatus to successively supply a plurality of said small bags to said transportation path.

24. An apparatus according to claim 23 wherein said small bag supplying apparatus feeds a second belt-like member having a plurality of the small bags to be connected with each other, the small bag supplying apparatus comprising said second belt-like member, feeding apparatus to feed the second belt-like member, a cutter to cut the second belt-like member into individual small bags and a distributing chute to distribute said individual small bags to said transportation paths one by one.

25. An apparatus according to claim 20 wherein said plurality of said attaching apparatuses are vertically provided along said transportation path.

26. An apparatus according to claim 20 wherein said attaching apparatus further comprises a mechanism for swinging said transportation path toward the first belt-like member.

27. An apparatus according to claim 26 wherein said mechanism causes said small bag waiting on the transportation path to face said first belt-like member with a small distance in between corresponding to a slope of the transportation path, and then said plate pushes up the small bags towards the adhesive layer.

28. An apparatus according to claim 20, further comprising a belt-like member feeding apparatus to successively feed said first belt-like member so that the first belt-like member faces said transportation path corresponding to a slope of the transportation path.

29. An apparatus according to claim 20 wherein said transportation path comprises a sliding chute to allow said small bags to slide down.

30. An apparatus according to claim 20 wherein said small bag comprises a freshness-keeping agent for foodstuffs, said agent contains a freshness-keeping agent composition in a gas permeable packaging material and said first belt-like member comprises packaging film used for a container for storage of foodstuffs.

31. An apparatus according to claim 24 wherein a plurality of packaging lines, each for packaging a substance to be preserved in a package which is at least partly formed from said first belt-like member, are provided and wherein said adhesive application apparatus, said transportation path and said attaching apparatus are provided for each of said lines and wherein one set of said distributing chute distributes said small bags divided from said second belt-like member to each of the transportation paths.

32. An apparatus according to claim 20 wherein a plurality of lines, each for packaging of a substance to be preserved in a package which is at least partly formed from said first belt-like member are provided and wherein said stopper and pusher are each provided for each of said packaging lines and wherein said stopper further comprises a stopper moving apparatus to simultaneously move said stoppers of all said packaging lines and further comprises a pusher apparatus to simultaneously move said pushers of all packaging lines.

33. An apparatus according to claim 23 wherein motion of said adhesive application apparatus, said small bag supplying apparatus and said attaching apparatus is controlled in synchronization with a motion signal for packaging a substance to be preserved in small bags, which small bags are attached to said first belt-like member.

34. An apparatus according to claim 20, further comprising a package supplying apparatus to successively supply packages for storing a substance to be packed, and a packaging apparatus to form said package at least in part from said first belt-like member to which said small bags are attached.

35. An apparatus according to claim 33 wherein said substance comprises foodstuffs, said small bag comprises a freshness-keeping agent which is made of a gas permeable packing material and a freshness-keeping agent composition placed in said gas permeable packing material, and said first belt-like member comprises a packaging film.

36. An apparatus according to claim 35 wherein said freshness-keeping agent is an oxygen absorber.

37. An apparatus according to claim 23 wherein two of said attaching apparatuses are vertically provided along said transportation path.

38. An apparatus according to claim 21 wherein each of said packaging lines are arranged in a parallel manner within a packaging machine.

* * * * *